US005892530A

United States Patent [19]

Ueda et al.

[11] Patent Number: 5,892,530

[45] Date of Patent: *Apr. 6, 1999

[54] COLOR THERMAL PRINTER AND PRINTING METHOD

[75] Inventors: Satoshi Ueda; Nobuo Katsuma, both of Saitama, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 774,684

[22] Filed: Dec. 26, 1996

[30] Foreign Application Priority Data

Dec. 27, 1995 [JP] Japan ..... 7-340483

[51] Int. Cl.[6] ..... B41J 2/32

[52] U.S. Cl. ..... 347/175; 400/120.03

[58] Field of Search ..... 347/175, 171, 347/238, 212, 244, 246, 232, 236, 239, 253, 256; 250/317.1, 319, 336.1; 355/83, 88, 68; 400/120.03

[56] References Cited

U.S. PATENT DOCUMENTS 5,216,438 6/1993 Nakao et al. ..... 347/172
5,463,417 10/1995 Yamakawa ..... 347/212
5,486,856 1/1996 Katsuma et al. ..... 347/175
5,629,729 5/1997 Fujishiro ..... 347/175

*Primary Examiner*—N. Le
*Assistant Examiner*—Anh T. N. Vo

[57] ABSTRACT

A color thermosensitive recording sheet includes a support and at least yellow, magenta and cyan thermosensitive coloring layers formed thereon. A color thermal printer has conveyor rollers for moving the recording sheet relative to a thermal head. The thermal head initially heats the recording sheet for recording on the yellow coloring layer. A yellow fixing lamp applies near ultraviolet rays to the recording sheet to fix the yellow coloring layer optically. The thermal head heats the recording sheet for recording on the magenta coloring layer. A magenta fixing lamp applies ultraviolet rays to the recording sheet to fix the magenta coloring layer optically. An irradiance sensor detects irradiance of the magenta fixing lamp during the magenta fixation. A refixing check circuit obtains a minimal irradiance of the detected irradiance, compares the minimal irradiance with a limit irradiance, and outputs a refixing command if the minimal irradiance is equal to or smaller than the limit irradiance. A driver turns on the magenta fixing lamp in response to the refixing command. A conveying speed determiner determines a speed of the conveyor rollers for the refixation according to the minimal irradiance. The conveyor rollers are operated at the determined speed while the magenta fixing lamp is turned on. The magenta fixing lamp refixes the recording sheet optically. Finally the thermal head heats the recording sheet for recording on the cyan coloring layer.

10 Claims, 3 Drawing Sheets

COLOR THERMAL PRINTER AND PRINTING METHOD

BACKGROUND OF THE INVENTION

1. Field of the Invention

The present invention relates to a color thermal printer and printing method. More particularly, the present invention relates to a color thermal printer and printing method capable of overcoming considerable smallness or lowness in the extent of optical fixation.

2. Description Related to the Prior Art

A color thermal printer of a direct printing type is used with a color thermosensitive recording material or recording sheet, in which thermosensitive coloring layers of cyan, magenta, and yellow are formed on a support. To print a full-color image, a thermal head is pressed against the recording sheet and applies heat to it, so as to record a yellow image to the yellow coloring layer one line after another at first. The yellow coloring layer has the highest heat sensitivity of the three layers. There is a yellow fixing ultraviolet lamp for emitting near ultraviolet rays peaking at a wavelength of 420 nm. Once the yellow coloring layer is heated, the yellow fixing lamp applies the near ultraviolet rays to it to fix it optically before heat energy for the magenta coloring layer next to be colored is applied. This is to destroy the further coloring ability of the yellow coloring layer to prevent it from being colored beyond desired density.

After yellow fixation, the thermal head records a magenta image to the magenta coloring layer one line after another. There is a magenta fixing ultraviolet lamp for emitting ultraviolet rays peaking at a wavelength of 365 nm. The magenta fixing lamp applies ultraviolet rays to fix it optically. Then the thermal head records a cyan image to the cyan coloring layer one line after another. The three-color frame-sequential recording is finished, to print the full-color image to the recording sheet.

During the printing operation, the recording sheet is conveyed past the thermal head continuously or intermittently one line after another. There are two types of a sheet conveying mechanisms: a back-and-forth moving type in which a pair of conveyor rollers make back-and-forth movement of the recording sheet three times; and a rotational type in which a platen drum of large size supports the recording sheet and makes three rotations.

When a ray emitting intensity of the yellow fixing lamp is too low, the yellow image is only fixed to a considerably small or low extent. Inevitably the remainder of the yellow coloring component after the yellow recording is colored in the recording of the magenta image. If the ray emitting intensity of the yellow fixing lamp is too high, a slight part of the magenta coloring component is decomposed optically, so that the magenta image only can be printed at the lowered density. It is therefore suggested to use a sensor for measuring the near ultraviolet rays from the yellow fixing lamp. Irradiance of the near ultraviolet rays immediately after the actuation is measured by the sensor. According to this, a driving condition of the yellow fixing lamp is determined to maintain the ray emitting intensity in a desired level.

When the considerable smallness or lowness in the extent of fixation occurs for the magenta image, the remainder of the magenta coloring component is colored in the cyan recording. However the cyan coloring layer does not have optical fixability, and is never influenced by overfixation of the magenta image. Consequently the magenta fixing lamp is fully driven without decreasing adjustment in the fixation of the magenta image.

A normal ultraviolet lamp has a phenomenon in which mercury is precipitated in the ultraviolet lamp, and deposited on the inside of its tube according to the number of times of the use of the ultraviolet lamp. It has been found that the deposits of the mercury cause the ultraviolet lamp to emit rays only at a small amount even with an equal power at which the lamp is driven.

In the conventional color thermal printer, the fixing condition is determined in such a manner that an exposure amount is optimized by fully driving the magenta fixing lamp as the ultraviolet lamp. The magenta fixing lamp having deposits of mercury is involved with the considerable smallness or lowness in the extent of fixation of the magenta image when the ray emitting intensity is minimal. The same problem occurs to an alternative recording sheet in which a magenta coloring layer is the deepest and a yellow coloring layer is the second deepest. The yellow image is no more fixed than to a considerable small extent.

SUMMARY OF THE INVENTION

In view of the foregoing problems, an object of the present invention is to provide a color thermal printer and printing method capable of overcoming the considerable smallness or lowness in the extent of optical fixation of a second deepest one of plural coloring layers of thermosensitive recording material.

In order to achieve the above and other objects and advantages of this invention, an irradiance sensor detects irradiance of a second fixing lamp during fixation of a second coloring layer, which is included in at least first, second and third thermosensitive coloring layers formed on a support of a color thermosensitive recording material, and the second fixing lamp is adapted to fixing the second coloring layer. A refixing check device is responsive to a signal from the irradiance sensor, for obtaining a minimal irradiance of the irradiance being detected, and for comparing the minimal irradiance with a limit irradiance, the refixing check device outputting a refixing command for instructing refixation if the minimal irradiance is equal to or smaller than the limit irradiance. A switch circuit turns on the second fixing lamp in response to the refixing command. A conveying speed determiner determines a conveying speed of the conveyor which moves the recording material relative to a thermal head, the conveying speed determiner determining the conveying speed for the refixation in accordance with the minimal irradiance, the conveyor being operated at the conveying speed being determined while the second fixing lamp is turned on before the recording to the third coloring layer, so that the second fixing lamp refixes the recording material optically.

In a preferred embodiment, the conveying speed determiner determines the conveying speed small for the refixation according to smallness of the minimal irradiance.

Furthermore, a ray intensity regulator determines a lamp control value in accordance with a signal from the irradiance sensor, to keep the irradiance of the second fixing lamp at a predetermined level.

In FIG. 3, a normal ultraviolet lamp has a characteristic such that, when fully driven to emit rays, the ray emitting intensity of the ultraviolet lamp becomes stable as indicated by a phantom line 2 in FIG. 3 at a lapse of short time after the supply of current. But there is a phenomenon in which mercury is precipitated in the ultraviolet lamp, and deposited on the inside of its tube according to the number of times the ultraviolet lamp has been used. It has been found that the deposits of the mercury give the ultraviolet lamp such a characteristic that, when fully driven to emit rays, the ray emitting intensity of the ultraviolet lamp changes as indicated by the solid line 3 in FIG. 3. The ray emitting intensity initially peaks in a manner similar to the normal lamp, but decreases to a minimal intensity depending upon the mercury deposits, and again increases.

In the present invention, the color thermal printer and printing method are capable of overcoming the problem of an inevitable abrupt decrease of ray intensity of a fixing ultraviolet lamp.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1A:
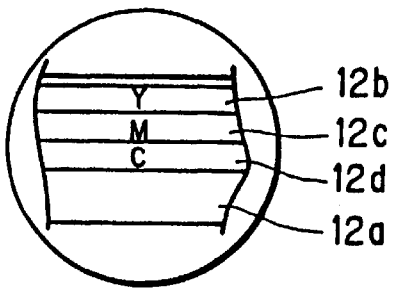
FIG. 1A is an explanatory view in section, illustrating a color thermosensitive recording sheet.
Figure 1:
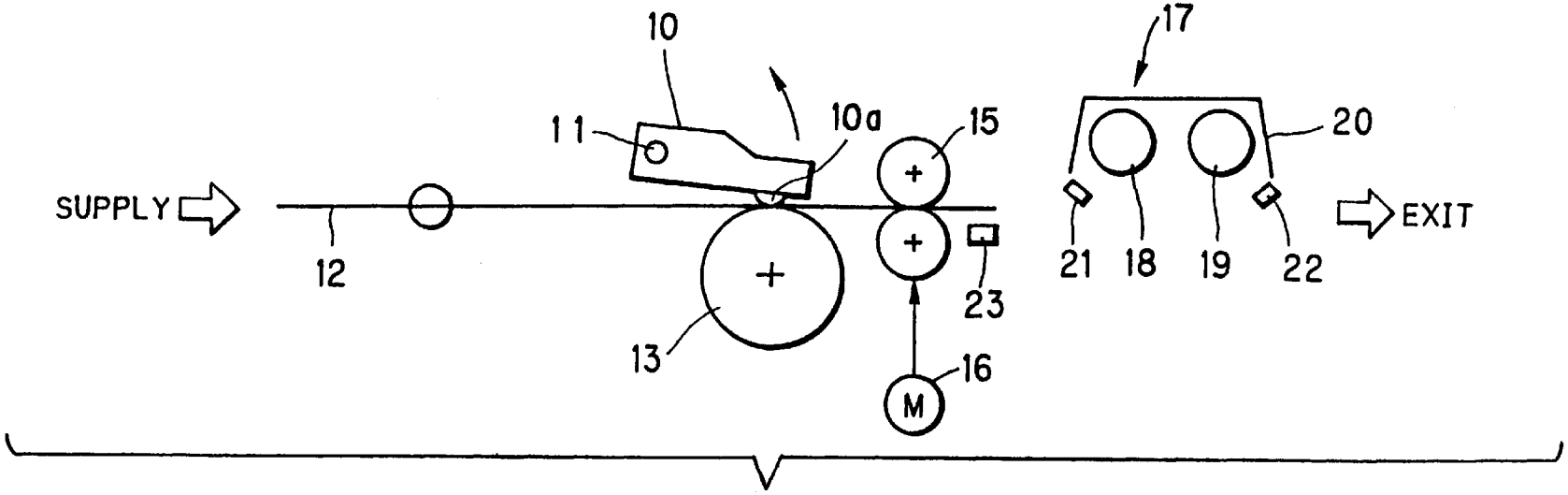
FIG. 1 is an explanatory view illustrating a color thermal printer.

In FIG. 1, a thermal head 10 includes of an array 10*a* of a great number of heating elements. The thermal head 10 is supported by a shaft 11 in a swingable manner between a printing position and a retracted position. In the printing position, the thermal head 10 presses a color thermosensitive recording sheet 12 set on a platen roller 13. In the retracted position, the thermal head 10 is moved away from the platen roller 13.

In FIG. 1A illustrating a layered structure of the recording sheet 12, the recording sheet 12 includes a support 12*a*, a cyan coloring layer 12*d*, a magenta coloring layer 12*c*, and a yellow coloring layer 12*b* disposed in the order listed. Recording operation is effected in the order from the recording surface toward the support 12*a*, namely yellow, magenta and cyan. The degree of heat sensitivity of each of the coloring layers 12*b*–12*d* depends upon closeness to the recording surface. In other words, the lowest heat energy is required for coloring the yellow coloring layer 12*b*. The highest heat energy is required for coloring the cyan coloring layer 12*d*. The yellow coloring layer 12*b* has optical fixability responsive to near ultraviolet rays of a wavelength range peaking at nearly 420 nm. The magenta coloring layer 12*c* has optical fixability responsive to ultraviolet rays of a wavelength range peaking at nearly 365 nm.

A pair of conveyer rollers 15 are disposed in a position downstream from the thermal head 10, and rotated by a stepping motor 16 in forward and reverse directions. The conveyor rollers 15 pinch the recording sheet 12 and move it back and forth.

An optical fixer 17 includes a yellow fixing ultraviolet lamp 18, a magenta fixing ultraviolet lamp 19 and a reflector 20 covering the back of the yellow fixing lamp 18 and the magenta fixing lamp 19. The yellow fixing lamp 18 as a first fixing lamp emits near ultraviolet rays peaking at a wavelength of 420 nm. The magenta fixing lamp 19 as a second fixing lamp emits ultraviolet rays peaking at a wavelength of 365 nm.

An irradiance sensor 21 receives and detects the near ultraviolet rays from the yellow fixing lamp 18 and measures irradiance of a surface of the recording sheet 12 indirectly. An irradiance sensor 22 receives and detects the ultraviolet rays from the magenta fixing lamp 19 and measures irradiance of the surface of the recording sheet 12 indirectly. A sheet sensor 23 detects a front edge of the recording sheet 12.

Figure 2:
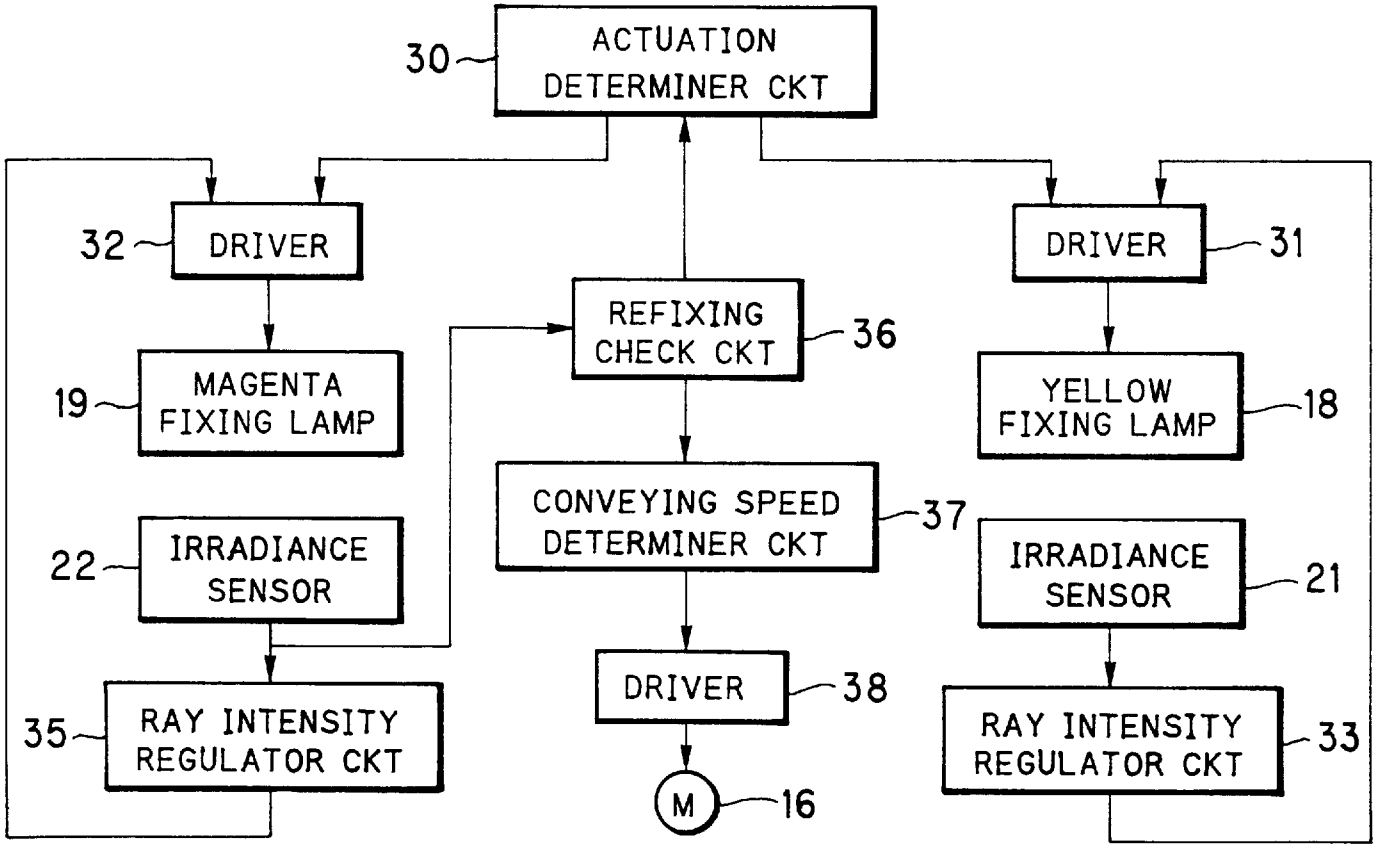
FIG. 2 is a block diagram illustrating an optical fixing device and circuitry relevant to refixing.

In FIG. 2, an actuation determiner circuit 30 is adapted to turn on and off the yellow fixing lamp 18 and the magenta fixing lamp 19 via drivers 31 and 32 as switch circuits. An irradiance signal from the irradiance sensor 21 is sent to a ray intensity regulator circuit 33 or inverter. The ray intensity regulator circuit 33 generates a signal of a lamp control value for obtaining target irradiance in consideration of the irradiance signal from the irradiance sensor 21 and sends the lamp control value to the driver 31. The driver 31 regulates the ray emitting intensity of the yellow fixing lamp 18 in accordance with the lamp control value. For this regulation, the driver 31 adjusts either a voltage applied to the yellow fixing lamp 18, or a duty factor of drive pulses supplied to the yellow fixing lamp 18. Note that the target irradiance for the yellow fixation is predetermined smaller than irradiance obtained by fully driving the yellow fixing lamp 18.

An irradiance signal from the irradiance sensor 22 is sent to a ray intensity regulator circuit 35 or inverter, which determines a lamp control value for obtaining target irradiance in consideration of the irradiance signal generated upon the lapse of a predetermined duration after the start of driving the magenta fixing lamp 19. The driver 32 receives the lamp control value, and responsively determines a driving condition suitable for the magenta fixing lamp 19 to emit rays at a desired intensity. Note that the target irradiance for the magenta fixation is predetermined smaller than irradiance obtained by fully driving the magenta fixing lamp 19.

The irradiance signal from the irradiance sensor 22 is sent to a refixing check circuit 36, which monitors the irradiance signal and obtains a minimal irradiance from it. The refixing check circuit 36 also compares the minimal irradiance with a limit irradiance stored in a memory. If the minimal irradiance is equal to or smaller than the limit irradiance, the refixing check circuit 36 executes.

When a refixing command is output from the refixing check circuit 36, the actuation determiner circuit 30 causes the driver 32 to actuate the magenta fixing lamp 19. A conveying speed determiner 37 determines a speed for conveying the recording sheet 12 in the refixation in accordance with the minimal value of the irradiance signal.

The operation of the above construction is described. The recording sheet 12 fed out of a feeding cassette (not shown) conveyed toward the thermal head 10. The thermal head 10 during the conveyance is set in the retracted position away from the platen roller 13. The recording sheet 12 is passed between the thermal head 10 and the platen roller 13, and then pinched between the conveyor rollers 15.

When the front edge of the recording sheet 12 between the conveyor rollers 15 is detected by the sheet sensor 23, the thermal head 10 is swung in the clockwise direction to move to the printing position pressing the recording sheet 12. The heating element array 10*a* of the thermal head 10 are driven according to yellow heating data, to record a yellow image to a recording area on the recording sheet 12 one line after another.

In the yellow recording, the actuation determiner circuit 30 causes the driver 31 to actuate the yellow fixing lamp 18 with a full driving signal. The yellow fixing lamp 18 emits near ultraviolet rays peaking at 420 nm. When a portion with the yellow image recorded comes to a position under the yellow fixing lamp 18, the near ultraviolet rays is applied to the portion to fix the yellow image.

While the yellow fixing lamp 18 emits the near ultraviolet rays, the irradiance sensor 21 receives part of the rays to measure the irradiance of the surface of the recording sheet 12 indirectly. The irradiance signal from the irradiance sensor 21 is sent to the ray intensity regulator circuit 33, which determines the lamp control value for obtaining the target irradiance in accordance with the irradiance detected. The driver 31 regulates the ray emission of the yellow fixing lamp 18 according to the lamp control value. This regulation is effected successively while the yellow fixing lamp 18 is driven, so that rays emitted from the yellow fixing lamp 18 are kept at a constant intensity. Irregularity in fixation is avoided.

Upon detection of the front edge of the recording sheet 12 with the sheet sensor 23, drive pulses for the stepping motor 16 start being counted so as to measure an amount of conveying the recording sheet 12. It is indirectly detected that a rear edge of the recording sheet 12 comes to a position which is near to the conveyor rollers 15 and adapted to start of reverse movement. Then the yellow printing is finished upon this detection.

Then the actuation determiner circuit 30 turns off the yellow fixing lamp 18. The thermal head 10 is swung in the counterclockwise direction to the retracted position. The stepping motor 16 starts rotation in the reverse direction to return the recording sheet 12 to the start position of printing as shown in FIG. 1.

When the recording sheet 12 is moved back to the start position, the stepping motor 16 starts rotating in the forward direction. The thermal head 10 is moved to the printing position to start the magenta recording. In the magenta recording, the actuation determiner circuit 30 causes the driver 32 to actuate the magenta fixing lamp 19. The magenta fixing lamp 19 emits ultraviolet rays peaking at 365 nm. Part of the rays from the magenta fixing lamp 19 driven fully are received by the irradiance sensor 22.

The ray intensity of the magenta fixing lamp 19 becomes stable at the lapse of several seconds after the start of the ray emission. The ray intensity regulator circuit 35 fetches or reads the irradiance signal from the irradiance sensor 22, for example, upon the lapse of several seconds after the start of the ray emission. The lamp control value is determined for obtaining the target irradiance in accordance with the irradiance signal being fetched. According to the lamp control value, the driver 32 adjusts either a voltage or a duty factor of drive pulses, to regulate the ray intensity of the magenta fixing lamp 19 at a constant level.

In the magenta recording, a yellow image is recorded to the recording area on the recording sheet 12 one line after another. When the portion with the magenta image recorded comes to a position under the magenta fixing lamp 19, the near ultraviolet rays is applied to the portion to fix the magenta image. The irradiance sensor 22 measures the irradiance also during the fixation, and sends the irradiance signal to the refixing check circuit 36.

Figure 3:
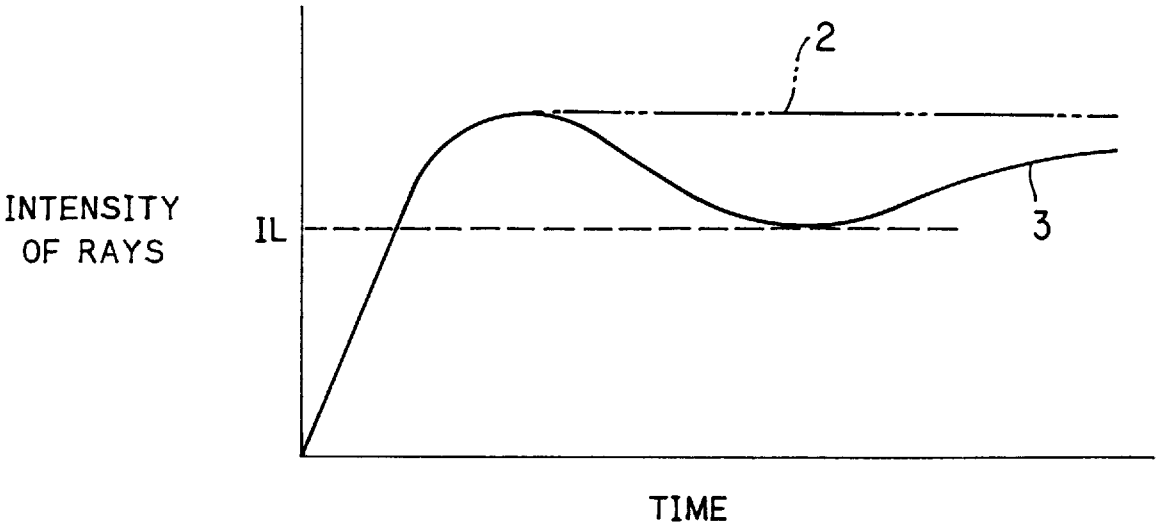
FIG. 3 is a graph illustrating a relationship between the ray emitting intensity and time of operation of an ultraviolet lamp.

In FIG. 3, the solid line indicates a case having deposits of mercury (Hg). Immediately upon the start of the emission, the intensity comes to a peak, and then decreases to the minimal intensity IL. The refixing check circuit 36 detects the minimal intensity IL by way of the minimal irradiance, and determines whether to effect a refixing operation. If the minimal irradiance as IL is greater than the limit irradiance, there is no refixing command. If the minimal irradiance as IL is equal to or smaller than the limit irradiance, the refixing check circuit 36 generates the refixing command, which is sent to the actuation determiner circuit 30 for the purpose of driving the magenta fixing lamp 19.

The conveying speed for the refixation is set low according to smallness of the minimal irradiance. The conveying speed determiner 37 sends a signal of the conveying speed being determined to a driver 38. It is to be noted that the conveying speed determiner 37 has a look-up table which is constituted by a relationship between the minimal irradiance and the conveying speed for refixation. The table is accessed at an address of the minimal irradiance, to obtain a single value of the speed.

When the refixing operation is commanded, the actuation determiner circuit 30 triggers the driver 32. The driver 32 causes the magenta fixing lamp 19 to emit rays according to the lamp control value equal to that initially used in the magenta fixation. The conveying speed determiner 37 causes the driver 38 to rotate the stepping motor 16 in the reverse direction at the speed determined from the table, until the recording sheet 12 is moved back to the start position of the printing.

While the recording sheet 12 is returned, ultraviolet rays from the magenta fixing lamp 19 are applied to the recording sheet 12 to refix the magenta image, namely to compensate for a deficit of an amount of rays in the initial magenta fixation. If there is no refixing command after the operation of the comparison, the magenta fixing lamp 19 is kept turned off while the recording sheet 12 is returned to the printing position.

When the cyan printing is started, the stepping motor 16 is rotated again in the forward direction to convey the recording sheet 12 at the constant speed. The thermal head 10 records a cyan image to the recording area one line after another.

When each heating element of the heating element array 10*a* develops color of one pixel, it applies bias heat energy and image heat energy of which a sum is required heat energy. In the heating with the bias heat energy, the target coloring layer is heated up to a state shortly before coloring, irrespective of coloring the pixel. In the cyan recording, all of the recording area is provided with a somewhat large bias heat energy, so that blank or white portions associated with a full-color image are inevitably colored light yellow. The light yellow is erasable by application of ultraviolet rays. Consequently the magenta fixing lamp 19 is driven also in the cyan recording.

After the cyan printing, the recording sheet 12 is bleached by ultraviolet rays from the magenta fixing lamp 19, and exited to a receptacle tray (not shown).

Note that it is possible to use a platen drum having a large size. The recording sheet is mounted on the periphery of the platen drum, to record one color per one rotation. In addition to the three rotations for the recording, one other rotation of the platen drum is made for refixation. It is also possible that a thermosensitive recording sheet includes a black coloring layer in addition to the cyan coloring layer 12*d*, the magenta coloring layer 12*c*, and the yellow coloring layer 12*b*. The present invention is applicable to this four-layer recording sheet by effecting the refixation to the third coloring layer as viewed from the recording surface. Furthermore the present invention is applicable to use of thermosensitive recording material including two, three, four or more coloring layers. In any recording material, the refixation is effected to the second deepest coloring layer.

In the above embodiment, the rays from the magenta fixing lamp 19 are controlled according to the lamp control value determined during the ray emission. Alternatively it is possible to drive the magenta fixing lamp 19 in a full manner for emitting ultraviolet rays without the ray intensity regulator circuit 35 and without regulating the rays.

Ray emission of the yellow fixing lamp 18 is continuously regulated for keeping irradiance constant. Alternatively it is possible that the lamp control value is determined according to the irradiance signal at the lapse of predetermined duration after the start of emission, and that the driving condition of the yellow fixing lamp 18 is initially determined according to the lamp control value.

It is also possible that the minimal irradiance of ultraviolet rays from the yellow fixing lamp 18 is detected, and that refixing operation for the yellow color is effected according to the minimal irradiance.

In the above embodiment, the minimal irradiance is the lowest value to which the irradiance of the magenta fixing lamp 19 decreases immediately after the irradiance has increased to a peak in response to a drive current. Immediately after the decrease to the lowest value, the irradiance of the magenta fixing lamp 19 increases again and becomes stable. The magenta fixing lamp 19 has such a characteristic that the minimal irradiance decreases according to a length of time of use. Alternatively the present invention is applicable to the use of an ultraviolet fixing lamp having other characteristics in time-sequential changes of irradiance.

The fixing lamps of the present invention are ultraviolet lamps, but can be other lamps or devices for emitting any kind of electromagnetic rays for the purpose of photochemical fixation of coloring layers.

In the above embodiment, the irradiance sensor 22 detects irradiance of the magenta fixing lamp 19 during fixation of the magenta coloring layer 12*c*. Alternatively it is possible to measure the irradiance experimentally before a printing sequence of the thermal printer for printing a full-color image. For example the thermal printer can be provided with such a function that the magenta fixing lamp 19 is experimentally turned on for emitting test rays either upon powering the printer or upon commanding start of the printing, and that the irradiance sensor 22 detects irradiance of the test rays from the magenta fixing lamp 19.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer for recording a full-color image on a color thermosensitive recording material, the recording material including a support and at least first, second and third thermosensitive coloring layers formed thereon, the coloring layers being different in heat sensitivity for developing color, said thermal printer comprising:

a thermal head;

a conveyor for moving the recording material relative to said thermal head, wherein said thermal head initially heats the recording material for recording on the first coloring layer;

a first fixing lamp for applying ultraviolet rays to the recording material in a first wavelength range to fix the first coloring layer optically, then said thermal head heats the recording material for recording on the second coloring layer;

a second fixing lamp for applying ultraviolet rays to the recording material in a second wavelength range to fix the second coloring layer optically, and then said thermal head heats the recording material for recording on the third coloring layer;

an irradiance sensor for detecting irradiance of the second fixing lamp during fixation of the second coloring layer;

refixing check means, responsive to a signal from said irradiance sensor, for obtaining a minimal irradiance of the irradiance being detected, and for comparing the minimal irradiance with a limit irradiance, said refixing check means outputting a refixing command signal for instructing refixation of said second coloring layer when the minimal irradiance is equal to or smaller than the limit irradiance;

a switch circuit for turning on the second fixing lamp in response to the refixing command signal; and a conveying speed determiner for determining a conveying speed of the conveyor, said conveying speed determiner determining the conveying speed for the refixation of said second coloring layer in accordance with the minimal irradiance, wherein the conveyor is operated at the conveying speed while the second fixing lamp is turned on before recording to the third coloring layer so that the second fixing lamp refixes the recording material optically.

2. The color thermal printer of claim 1, wherein said conveying speed determiner determines the conveying speed to be low for the refixation when the minimal irradiance is small.

3. The color thermal printer of claim 2, further comprising:

ray intensity regulator means for determining a lamp control value in accordance with the signal from said irradiance sensor, to keep the irradiance of the second fixing lamp at a predetermined level.

4. The color thermal printer of claim 3, wherein the conveyor includes at least one pair of conveyor rollers for moving the recording material in forward and reverse directions while pinching the recording material; wherein the thermal head records on the first, second and third coloring layers while the conveyor rollers move the recording material in the forward direction; the second fixing lamp initially fixes the second coloring layer while the conveyor rollers move the recording material in the forward direction; and the second fixing lamp refixes the second coloring layer while the conveyor rollers move the recording material in the reverse direction.

5. The color thermal printer of claim 4, wherein the first fixing lamp fixes the first coloring layer while the conveyor rollers move the recording material in the forward direction.

6. The color thermal printer of claim 5, wherein the first coloring layer is yellow, the second coloring layer is magenta, and the third coloring layer is cyan.

7. A color thermal printing method of recording a full-color image on a color thermosensitive recording material, the recording material including a support and at least first, second and third thermosensitive coloring layers formed thereon, the coloring layers being different in heat sensitivity for developing color, said thermal printing method comprising steps of:

initially heating the recording material for recording on the first coloring layer;

applying ultraviolet rays with a first fixing lamp to the recording material in a first wavelength range to fix the first coloring layer optically, then heating the recording material for recording to the second coloring layer;

applying said ultraviolet rays with a second fixing lamp to the recording material in a second wavelength range to fix the second coloring layer optically, and then heating the recording material for recording on the third coloring layer;

detecting irradiance of the second fixing lamp during fixation of the second coloring layer;

obtaining a minimal irradiance of the detected irradiance;

comparing the minimal irradiance with a limit irradiance when the minimal irradiance is equal to or smaller than the limit irradiance, outputting a refixing command signal for instructing the second fixing lamp for refixation of the second coloring layer;

determining a conveying speed for the refixation of said second coloring layer in accordance with the minimal irradiance;

turning on the second fixing lamp while moving the recording material at the conveying speed, the second fixing lamp applying ultraviolet rays to the recording material in the second wavelength range to refix the second coloring layer optically.

8. The color thermal printing method of claim 7, wherein the conveying speed is set low when the minimal irradiance is small.

9. The color thermal printing method of claim 8, wherein the recording material is moved in forward and reverse directions relative to the thermal head;

wherein the thermal head records on the first coloring layers and the first fixing lamp initially fixes the first coloring layer while said recording material is moved in said forward direction;

then the recording material is moved in the reverse direction;

then the thermal head records on the second coloring layers and the second fixing lamp initially fixes the second coloring layer while the recording material is moved in the forward direction;

then the second fixing lamp refixes the second coloring layer while the recording material is moved in the reverse direction; and then the thermal head records on the third coloring layers while the recording material is moved in the forward direction.

10. The color thermal printing method of claim 9, wherein the first coloring layer is yellow, the second coloring layer is magenta, and the third coloring layer is cyan.

* * * * *